US007485177B1

(12) United States Patent
McConnell et al.

(10) Patent No.: US 7,485,177 B1
(45) Date of Patent: Feb. 3, 2009

(54) VOLATILE CORROSION INHIBITING MIXTURE WITH TRACING AGENT

(75) Inventors: Robin McConnell, Rochester Hills, MI (US); Wesley Raymond Measel, Jr., New Boston, MI (US)

(73) Assignee: SKS Industries, Howell, MI (US)

( * ) Notice: Subject to any disclaimer, the term of this patent is extended or adjusted under 35 U.S.C. 154(b) by 0 days.

(21) Appl. No.: 11/780,613

(22) Filed: Jul. 20, 2007

(51) Int. Cl.

| | |
|---|---|
| ***C23F 11/00*** | (2006.01) |
| ***C23F 15/00*** | (2006.01) |
| ***C08K 5/00*** | (2006.01) |
| ***C08K 5/15*** | (2006.01) |
| ***C08K 5/1545*** | (2006.01) |
| ***C08K 5/34*** | (2006.01) |
| ***C08K 5/3445*** | (2006.01) |
| ***C08K 5/45*** | (2006.01) |
| ***C09K 3/00*** | (2006.01) |
| ***C09K 15/00*** | (2006.01) |

(52) U.S. Cl. ..... 106/14.41; 106/14.05; 106/14.11; 106/14.13; 106/14.14; 106/14.15; 106/14.42; 106/14.43; 106/14.44; 252/387; 252/394; 252/395; 252/396; 524/84; 524/106; 524/110; 524/481; 524/486; 524/502; 524/522; 524/523; 524/569

(58) Field of Classification Search ..... 106/14.05, 106/14.11, 14.13, 14.15, 14.14, 14.41, 14.42, 106/14.43, 14.44; 252/387, 394, 395, 396; 524/84, 106, 110, 481, 486, 502, 522, 523, 524/569

See application file for complete search history.

(56) References Cited

U.S. PATENT DOCUMENTS

| | | | | |
|---|---|---|---|---|
| 3,443,577 | A | | 5/1969 | Nilsson |
| 3,836,077 | A | | 9/1974 | Skildum |
| 3,967,926 | A | | 7/1976 | Rozenfeld et al. |
| 4,051,066 | A | | 9/1977 | Miksic et al. |
| 4,124,549 | A | | 11/1978 | Hashiudo et al. |
| 4,275,835 | A | | 6/1981 | Miksic et al. |
| 4,290,912 | A | | 9/1981 | Boerwinkle et al. |
| 4,338,209 | A | | 7/1982 | Manabe et al. |
| 4,349,457 | A | | 9/1982 | Orillion |
| 4,402,747 | A | | 9/1983 | Bird et al. |
| 4,416,701 | A | | 11/1983 | Huster et al. |
| 4,454,266 | A | | 6/1984 | Coughlan |
| 4,557,966 | A | | 12/1985 | Weil |
| 4,762,167 | A | * | 8/1988 | Dobson ..... 165/11.1 |
| 4,963,290 | A | | 10/1990 | Bressan et al. |
| 4,973,448 | A | | 11/1990 | Carlson et al. |
| 5,166,074 | A | * | 11/1992 | Vessey et al. ..... 436/103 |
| 5,209,869 | A | | 5/1993 | Miksic et al. |
| 5,303,743 | A | | 4/1994 | Vincent |
| 5,320,778 | A | | 6/1994 | Miksic et al. |
| 5,332,525 | A | | 7/1994 | Miksic et al. |
| 5,344,589 | A | | 9/1994 | Miksic et al. |
| 5,393,457 | A | | 2/1995 | Miksic et al. |
| 5,422,187 | A | | 6/1995 | Miksic et al. |
| 5,455,075 | A | | 10/1995 | Longo |
| 5,888,281 | A | | 3/1999 | Longo |
| 6,033,599 | A | | 3/2000 | Lozano et al. |
| 6,124,044 | A | | 9/2000 | Swidler |
| 6,787,065 | B1 | | 9/2004 | Schapira et al. |
| 2004/0170848 | A1 | * | 9/2004 | Ludwig et al. ..... 428/470 |

* cited by examiner

*Primary Examiner*—Anthony J Green
(74) *Attorney, Agent, or Firm*—Robert K. Roth; Miller, Canfield Paddock and Stone PLC

(57) ABSTRACT

A corrosion inhibiting mixture is disclosed comprising a carrier, a volatile corrosion inhibitor and a tracing agent which absorbs light in the ultraviolet and violet region of the electromagnetic spectrum, and re-emits light in the blue region of the electromagnetic spectrum.

9 Claims, No Drawings

VOLATILE CORROSION INHIBITING MIXTURE WITH TRACING AGENT

FIELD OF THE INVENTION

This invention relates to improvements in volatile corrosion inhibitors, and more particularly to improvements in identifying and tracking volatile corrosion inhibitor mixtures.

BACKGROUND OF THE INVENTION

In many applications corrosion of metal articles exposed to air is a significant problem. A variety of techniques are used to reduce or prevent such corrosion. For example, metal articles have been packaged with a material containing a volatile corrosion inhibitor ("VCI"). VCIs function by slowly releasing vapors that contact the surface of the metals. The vapor phase corrosion inhibitors envelop the metal article in a non-corrosive layer and retard moisture and oxygen present in the atmosphere from attacking and reacting with the metal surfaces. Volatile corrosion inhibitors may be applied by combining the VCI with a liquid and spraying the entire surface of the metal article to be protected. Alternatively, the metal article itself may be enclosed, packaged or surrounded in or with materials containing VCIs. For example, VCIs may be incorporated into a packaging material such as paper and plastic wraps, films, and plastic dunnage. VCIs are also known to be incorporated into an emitting device with a binding matrix. Such emitters can be used within closed spaces such as packaging containers, electrical boxes, storage bags, and other enclosures. Different volatile corrosion inhibitors or combinations of volatile corrosion inhibitors may be selected based on the type of metal to be protected, the size of the enclosure, and the length of time that protection is required.

Examples of known VCI mixtures include U.S. patent application Ser. No. 11/588,885 assigned to the assignee of the present invention, which discloses a VCI mixture comprising a volatile corrosion inhibitor and a resin based binding matrix which is heated and irreversibly cured. Such a mixture is highly advantageous in that it allows for controlled release of VCIs, can be formed at relatively low temperatures and can be formed in a variety of shapes.

One of the issues with current volatile corrosion inhibitor emitting packaging materials is that the volatile corrosion inhibitor often can not be seen or detected by close inspection. This creates a number of drawbacks to the use of volatile corrosion inhibitors. For example, end users of the packaging article do not have a convenient method to confirm that the packaging article contains an appropriate volatile corrosion inhibitor mixture and an appropriate amount of the appropriate VCI mixture. Further, VCI concentrates or master batches are often sold to vendors that are contracted to manufacture packaging articles that contain volatile corrosion inhibitors. Unless expensive analytical tests are performed, it is difficult to assure that the vendor incorporated the VCI concentrate or master batch into the articles in the right amounts. In addition, many times volatile corrosion inhibiting packaging articles are sold through distribution where they are stored with numerous similar articles that do not contain volatile corrosion inhibitor. It can be difficult to differentiate between the two types of packaging articles. Also, volatile corrosion inhibitor concentrates or master batches are sometimes sold to customers that wish to produce and sell packaging articles that contain volatile corrosion inhibitors. Often times these customers buy volatile corrosion inhibiting concentrates from more than one source. If performance problems arise from the application of these packaging articles, there is no way of knowing which volatile corrosion inhibiting concentrate had the problem.

It would be highly desirable to provide a simple way of determining whether a given volatile corrosion inhibiting mixture is present in or on an article.

SUMMARY OF THE INVENTION

In accordance with a first aspect, a corrosion inhibiting mixture is disclosed comprising a carrier, a volatile corrosion inhibitor, and a tracing agent which absorbs light in the ultraviolet and violet region of the electromagnetic spectrum, and re-emits light in the blue region of the electromagnetic spectrum.

From the foregoing disclosure and the following more detailed description of various preferred embodiments it will be apparent to those skilled in the art that the present invention provides a significant advance in the technology of volatile corrosion inhibitors. Particularly significant in this regard is the potential the invention affords for providing a high quality, low cost volatile corrosion inhibitor mixture tracing agent. Additional features and advantages of various preferred embodiments will be better understood in view of the detailed description provided below.

DETAILED DESCRIPTION OF CERTAIN PREFERRED EMBODIMENTS

It will be apparent to those skilled in the art, that is, to those who have knowledge or experience in this area of technology, that many uses and design variations are possible for the volatile corrosion inhibiting device disclosed here. The following detailed discussion of various alternative and preferred features and embodiments will illustrate the general principles of the invention with reference to a volatile corrosion inhibiting device suitable for use in an application where it is desired to protect metal. Other embodiments suitable for other applications will be apparent to those skilled in the art given the benefit of this disclosure.

In accordance with a preferred embodiment, a volatile corrosion inhibitor mixture comprises a carrier, a volatile corrosion inhibitor and a tracing agent. Volatile corrosion inhibitors sublime to the vapor phase under ambient conditions and reach surfaces to be protected to help provide temporary corrosion prevention of the surface, typically a metal object. Different corrosion inhibitors or combinations of corrosion inhibitors are selected based on the type of metal to be protected, the size of the enclosure, and the length of time that protection is required. Examples of suitable VCIs include benzoic acid and inorganic salts of benzoic acid such as sodium benzoate, inorganic nitrite salts such as sodium nitrite, amine nitrite salts such as dicyclohexylamine nitrite, carboxylic acids such as caprylic acid, salts of amines and carboxylic acids such as cyclohexylamine benzoate, monoethanolamine benzoate, diethylethanolamine caprylate, and diethylethanolamine caprate, azoles such as tolyltriazole, benzotriazole and their salts, and salts of molybdenum such as sodium molybdate or an amine molybdate. Other volatile corrosion inhibitors suitable for use herein will be readily apparent to those skilled in the art given the benefit of this disclosure.

VCI products can be formed in several ways. For example, a VCI may be mixed with a carrier such as liquid and sprayed onto the substrate to be protected. The liquid evaporates and leaves a thin layer of VCI on the substrate. Alternatively, a VCI may be applied to a carrier such as paper, thin plastic or another material with relatively high surface area. Typically VCIs applied in this manner have a solvent (such as water) as the carrier. The VCI is mixed with the solvent and then coated, impregnated or otherwise applied to the carrier. Also, it is common for vapor-phase or volatile corrosion inhibitor master batches or concentrates to be formed and used in manufacture of poly films, VCI impregnated paper, molded plastic, and other packaging materials which incorporate VCIs.

VCI products can be formed where the VCI is incorporated in to the carrier, as when mixed into a binding matrix such as a resin. For example, a volatile corrosion inhibitor emitting device can be readily molded or cast, which allows the emitting device to form a shape that fits a particular application. This is advantageous in that the device can be custom fitted to an enclosure, a packaging container or the items being protected from corrosion. Emitters may be formed as a narrow cylinder to protect gun barrels, fish-shaped to protect tackle boxes, a bolt to protect tool boxes, a blue shield to protect ferrous based metals, a red shield to protect electrical boxes, a thin strip emitter comprising a resin with the VCI mixed into the plastic, etc.

The binding matrix can preferably comprise one of several resins, for example, a plastisol, a urethane or an epoxy. Plastisols are dispersions of fine particle size polyvinyl chloride (PVC) or acrylic polymer or copolymer resins in liquid plasticizers which require heat to harden. Organosols may also be used. Organosols are plastisols to which a volatile solvent or thinner has been added. Plastisols typically require a plasticizer, an additive which softens the mixture to which it is are added. Plasticizers work by embedding themselves between the chains of polymers, space them apart (increasing of the "free volume"), and thus significantly lowering the glass transition temperature for the plastic and making it softer. Suitable plasticizers for use with PVC are a phthalate, a benzoate, an adipate, or a polymeric plasticizer, etc. An acrylic monomer may be used with a plastisol as a cross linking resin to adjust the hardness of the resulting mixture.

In addition to the resins and plasticizers, heat or light stabilizers, color pigments, flame retardants, blowing agents, fillers, viscosity control agents, rheology control additives or other additives may be included as determined by the intended end use. The rate of VCI release from the emitter is controlled by adjusting the components the polymer binding matrix to provide a steady, long lasting rate of emission.

The tracing agent may comprise an optical brightener, a fluorescent brightening agents or a fluorescent whitening agents. Preferably the optical brightner comprises a dye that absorbs light in the ultraviolet and violet region of the electromagnetic spectrum, and re-emit light in the visible blue region. Generally, products that incorporate any of an optical brightener, a fluorescent brightening agent, or a fluorescent whitening agent will show up as strongly fluorescent under UV illumination. Thus, exposure of the VCI mixture to ultraviolet light allows for a straightforward method for determining if a desired VCI is present and if the VIC is generally present in the correct amounts. Examples of appropriate optical brighteners comprise benzoxazole based fluorescent brightening agents such as 2,5-Bis-5-tert-butyl-2-benzoxazolythiophene manufactured by 3V, Inc. under the trade name of Optiblanc PL, and by Mayzo under the trade name of Benetex OB; coumarin based fluorescent brightening agents, for example 2H-1-Benzopyran-2-one,7-(diethylamino)-4-methyl manufactured by 3V Inc. under the trade name of Optiblanc SPL10; and stilbenic based brighteners such as diaminostilbene sulfonate derivatives, pyrazoline based optically active agents, such as 4,5-Dihydro-1H-pyrazoles, 1,3-diphenyl-5-(4-chlorophenyl)-2-pyrazoline and 1,5-diphenyl-3-biphenyl-2-pyrazoline, etc.

Listed below is a summary of several compositions with preferred ranges which produce a mixture having suitable properties for use as a volatile corrosion inhibitor emitting device with a tracing agent.

| Example 1. Poly film concentrate example: | |
|---|---|
| Polyethylene or other polyolefin resin | 50-90% |
| Volatile corrosion inhibitor | 10-50% |
| Optical brightener tracing agent | 0.001-5% |
| Other additives (processing aids, stabilizers, etc.) | 0-10% |

The above components are compounded into a volatile corrosion inhibitor concentrate mixture in the form of pellets. The volatile corrosion inhibitor mixture pellets are then used as an additive in the manufacture of polyolefin films and packaging articles. The volatile corrosion inhibitor pellets are commonly used as an additive in a concentration range of 2-20%.

The same process can be used for other types of plastic packaging articles. They may be based on plastics such as: ethylene vinyl acetate, Poly vinyl chloride, Polyethylene terephthalate, acrylics, silicones, polyurethanes, cellulose, rubber, polystyrene etc. The use of optical brighteners in conjunction with volatile corrosion inhibitors is also applicable to bioplastics such as: corn starch, polyhydroxy alkanoates, polylactic acid, sorona, polycaprolactone, copolyester, gluten, and soya protein based packaging articles.

| Example 2. Paper example: | |
|---|---|
| Water | 20-80% |
| volatile corrosion inhibitor component(s) | 20-80% |
| Optical brightener | 0.001-5% |
| Other additives (processing aids, stabilizers, etc.) | 0-20% |

The above aqueous based volatile corrosion inhibitor concentrate is coated onto, or impregnated into paper products for use in packaging applications. The same type of process applies to solvent based coating applications as well.

| Binding Matrix example | |
|---|---|
| Resin (plastisols, urethane, epoxy) | 20-80% (by weight) |
| Plasticizer (for use with plastisols only) | 15-35% |
| Cross Linking Resin (for use with plastisols) | 0-10% |
| Hardener (for use with epoxy and urethane only) | 3-10% |
| Viscosity Control Agent | 1-10% |
| Filler | 0-30% (10-30% with epoxy and urethane) |
| VCI | 10-50% |
| Optical brightener | 0.001-5% |

Suitable hardeners for urethane include isocyanates and diisocyanates. Suitable hardeners for epoxies include amines (diamines, triamines, etc.) and amine adducts. Suitable viscosity control agents comprise mineral spirits, texanol diisobutyrate ("TXIB") and viscosity modifiers from such as BYK Chemie: BYK-3105, BYK-3155, BYK-4040. Suitable fillers comprise calcium carbonate, Kaolin Clay and talk (magnesium silicate). Other hardeners, viscosity control agents and fillers will be readily apparent to those skilled in the art given the benefit of this disclosure.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A corrosion inhibiting mixture comprising, in combination:

a carrier;

a volatile corrosion inhibitor;

a tracing agent which absorbs light in the ultraviolet and violet region of the electromagnetic spectrum, and re-emits light in the blue region of the electromagnetic spectrum; and a plastic, wherein the carrier, volatile corrosion inhibitor and tracing agent form a concentrate used as an additive to the plastic in a concentration range of about 2-20% to form a packaging material;

wherein the carrier is a binding matrix comprising a plastisol formed from a plasticizer and one of a PVC resin and an acrylic co-polymer.

2. The corrosion inhibiting mixture of claim 1 wherein the volatile corrosion inhibitor is selected from the group consisting of at least one of benzoic acid, a salt of benzoic acid, an inorganic nitrite salt, an amine nitrite salt, a carboxylic acid, a salt of a carboxylic acid, a salt of an amine, an azole, a salt of an azole, a salt of molybdenum and an amine molybdates.

3. The corrosion inhibiting mixture of claim 1 wherein the volatile corrosion inhibitor comprises about 10-50% by weight of the mixture, the carrier is a binding matrix comprising about 90-50% by weight of the mixture, and the tracing agent comprise about 0.001-5% of the mixture.

4. The corrosion inhibiting mixture of claim 1 wherein the plastisol is a PVC resin which comprises about 20-80% by weight of the mixture, and the plasticizer comprises about 15-35% by weight of the mixture.

5. The corrosion inhibiting mixture of claim 1 wherein the plastisol is an acrylic copolymer and the resin further comprises a cross linking resin.

6. The corrosion inhibiting mixture of claim 4 further comprising a viscosity control agent in the amount of 1-10% by weight of the mixture, comprising one of mineral spirits, texanol diisobutyrate and a viscosity modifier.

7. The corrosion inhibiting mixture of claim 1 wherein the tracing agent comprises one of benzoxazole based fluorescent brightening agents, coumarin based fluorescent brightening agents, stilbenic based brighteners and pyrazoline based optically active agents.

8. The corrosion inhibiting mixture of claim 1 wherein the tracing agent comprises one of 2,5-bis-5-tert-butyl-2-benzoxazolythiophene, 2H-1-Benzopyran-2-one,7-(diethylamino)-4-methyl, a diaminostilbene sulfonate derivative, a 4,5-Dihydro-1H-pyrazole, 1,3-diphenyl-5-(4-chlorophenyl)-2-pyrazoline and 1,5-diphenyl-3-biphenyl-2-pyrazoline.

9. The corrosion inhibiting mixture of claim 1 wherein the carrier, volatile corrosion inhibitor and tracing agent are formed as pellets which are mixed with the plastic.

* * * * *